US006460444B2

(12) United States Patent
Jacko

(10) Patent No.: US 6,460,444 B2
(45) Date of Patent: Oct. 8, 2002

(54) ROTARY APPARATUS FOR CUTTING A FOOD PRODUCT

(75) Inventor: Michael S. Jacko, Chesterton, IN (US)

(73) Assignee: Urschel Laboratories, Inc., Valparaiso, IN (US)

( * ) Notice: Subject to any disclaimer, the term of this patent is extended or adjusted under 35 U.S.C. 154(b) by 0 days.

(21) Appl. No.: 09/800,583

(22) Filed: Mar. 8, 2001

(65) Prior Publication Data

US 2001/0008097 A1 Jul. 19, 2001

Related U.S. Application Data

(63) Continuation of application No. 09/299,648, filed on Apr. 27, 1999, now abandoned, which is a continuation of application No. 09/019,701, filed on Feb. 6, 1998, now Pat. No. 5,896,801, which is a continuation of application No. 08/653,127, filed on May 24, 1996, now abandoned, which is a continuation of application No. 08/250,924, filed on May 31, 1994, now abandoned.

(51) Int. Cl.[7] ..... B26D 1/25
(52) U.S. Cl. ..... 83/865; 83/592; 83/932
(58) Field of Search ..... 83/592, 622, 932, 83/408, 865, 356.3, 857, 425.3, 707.1, 862, 666; 241/291, 292.1, 37.5, 199.12; 30/305, 353

(56) References Cited

U.S. PATENT DOCUMENTS

| | | | | |
|---|---|---|---|---|
| 87,196 | A | | 2/1869 | Peers |
| 827,906 | A | * | 8/1906 | Cassady |
| 1,142,681 | A | | 6/1915 | Denis |
| 1,157,013 | A | | 10/1915 | Lewis |
| 1,714,413 | A | | 8/1927 | Woodward et al. |
| 2,114,428 | A | | 9/1936 | Mesterton |
| 2,482,523 | A | | 11/1944 | Urschel et al. |
| 2,465,670 | A | | 1/1945 | Urschel et al. |
| 2,522,143 | A | | 11/1947 | Strassenburg |
| 2,511,464 | A | | 6/1950 | Cover |
| 2,767,752 | A | | 11/1950 | Stahmer |
| 2,557,539 | A | * | 6/1951 | Henrickson |

(List continued on next page.)

FOREIGN PATENT DOCUMENTS

| | | |
|---|---|---|
| CH | 624 044 | 7/1981 |
| DE | 320838 | 5/1920 |

*Primary Examiner*—Kenneth E. Peterson
(74) *Attorney, Agent, or Firm*—Bacon & Thomas, PLLC

(57) ABSTRACT

An apparatus for cutting a food product is disclosed which utilizes a cutting wheel having a plurality of knives extending between a hub and a rim in conjunction with other cutting knives to produce a multi-dimensional cut of the food product. The use of the additional cutting knives enables the apparatus to dice a thin layered or leafy food product (cut it into small pieces) as opposed to merely slicing the food product in a single dimensional cut. The additional cutting knives may include one or more julienne knives attached to each of the knives of the cutting wheel so as to extend approximately at right angles to the cutting plane defined by the cutting wheel knives. A circular knife may be located upstream of the cutting plane defined by the cutting wheel such that the rotary knife longitudinally cuts the food product before it passes through the cutting plane. The apparatus according to the invention also utilizes separate drive motors for the feed conveyor and for the cutting wheel. In order to prevent deflection or deformation of the larger cutting wheel, a rim stabilizer engages the cutting wheel rim to prevent any deflection of the rim which, may cause deflection of the cutting knives, as the cutting wheel rotates.

1 Claim, 9 Drawing Sheets

U.S. PATENT DOCUMENTS

| | | | | |
|---|---|---|---|---|
| 2,580,526 | A | * | 1/1952 | Dawson |
| 2,265,723 | A | | 2/1953 | Urschel et al. |
| 2,924,256 | A | | 4/1957 | Reiland |
| 3,004,572 | A | | 7/1957 | Urschel et al. |
| 2,950,531 | A | * | 8/1960 | Nolte, Jr. |
| 3,395,742 | A | | 8/1968 | Sanders |
| 4,205,570 | A | | 6/1980 | Soodalter |
| 4,212,431 | A | | 7/1980 | Doyel |
| 4,300,429 | A | | 11/1981 | Brown et al. |
| 4,367,667 | A | | 1/1983 | Shibata |
| 4,393,737 | A | | 7/1983 | Shibata |
| 4,590,835 | A | | 5/1986 | Matsuo |
| 4,926,726 | A | | 5/1990 | Julian |
| 5,010,796 | A | | 4/1991 | Mendenhall |
| 5,058,478 | A | | 10/1991 | Mendenhall |
| 5,125,308 | A | | 6/1992 | Mendenhall |
| 5,224,409 | A | | 7/1993 | Cimperman et al. |
| 5,331,874 | A | | 7/1994 | Foster et al. |
| 5,765,472 | A | | 6/1998 | Kim |

* cited by examiner

ROTARY APPARATUS FOR CUTTING A FOOD PRODUCT

This application is a continuation of U.S. patent application Ser. No. 09/299,648 filed Apr. 27, 1999, now abandoned, which is a continuation of U.S. patent application Ser. No. 09/019,701 filed Feb. 6, 1998, now U.S. Pat. No. 5,896,801, which is a continuation of U.S. patent application Ser. No. 08/653,127 filed May 24, 1996, now abandoned, which is a continuation of U.S. patent application Ser. No. 08/250,924 filed May 31, 1994, now abandoned.

BACKGROUND OF THE INVENTION

The present invention relates to an apparatus for cutting a food product, more particularly, such an apparatus utilizing a rotatable cutting wheel having a plurality of generally radial slicing knives which define a cutting plane.

Known devices for slicing a food product typically comprise a rotatable slicing wheel having a plurality of knives extending between a hub and a rim so as to define a cutting plane and a conveying device for conveying the food product through the cutting plane. The speed of the feed device and the rotating speed of the cutting wheel are synchronized such that the food product is sliced into substantially uniform thickness slices. While generally successful, these known slicing machines have been heretofore limited to cutting the food product into slices and have been somewhat limited in the overall size of the food product which may be accommodated. The known food slicing devices also utilize a single motor to drive both the food product feed conveyor and the rotating cutting wheel. While the use of a single motor promotes accurate synchronization of the feed means and the cutting wheel speed, it results in a complicated drive arrangement requiring numerous lubrication points and increased maintenance.

The known slicing machines have been found inadequate for slicing food products such as Iceberg and Romaine lettuce. It has been necessary to precut the lettuce heads into halves or quarters before feeding them into the known slicing machines which are capable of making only a single dimension slicing cut. Thus, the known slicing machines have been utilized only to make shredded lettuce. The lettuce food products may be diced on a known dicing type of dicing apparatus, however, the size of the food product is, again, limited and the known devices are capable of producing only approximately 4,000 lbs. of food product per hour of operation. In order to properly dice a food product, such as lettuce, it is necessary for the apparatus to provide more than a one dimensional cut. This requirement has heretofore rendered the known slicing devices to be inappropriate for dicing food products.

SUMMARY OF THE INVENTION

An apparatus for cutting a food product is disclosed which utilizes a cutting wheel having a plurality of knives extending between a hub and a rim in conjunction with other cutting knives to produce a multidimensional cut of the food product. The use of the additional cutting knives enables the apparatus to dice a thin layered or leafy food product (cut it into small pieces) as opposed to merely slicing the food product in a single dimensional cut. The additional cutting knives may include one or more julienne knives attached to each of the knives of the cutting wheel so as to extend approximately at right angles to the cutting plane defined by the cutting wheel knives. Also, a circular knife may be located upstream of the cutting plane defined by the cutting wheel such that the rotary knife longitudinally cuts the food product before it passes through the cutting plane. The combination of the cutting knives enables this apparatus to dice a food product, such as lettuce, causing minimal bruising to the food product, thereby extending its shelf life.

The apparatus according to the invention also utilizes separate drive motors for the feed conveyor and for the cutting wheel. The use of separate drive motors eliminates the complicated drive mechanism of the known devices and enables the size of the apparatus to be increased so as to accommodate larger sized food products. The device of the present invention is capable of dicing approximately 15,000 lbs./hour of Iceberg lettuce, a significantly greater capacity than the known dicing machines.

In order to prevent deflection or deformation of the larger cutting wheel, a rim stabilizer engages the cutting wheel rim to prevent any deflection of the rim which, may cause deflection of the cutting knives, as the cutting wheel rotates. The rim stabilizer has one or more rotatable rollers which engage a groove defined in the nm of the cutting wheel so as to prevent any deflection in directions on either side of the cutting plane. The rim stabilizer may be moved out of engagement with the rim in order to facilitate removal or installation of the cutting wheel on the apparatus. Increased size of the apparatus, including the increased diameter cutting wheel, enables the apparatus to accept a food product of approximately 6½ inches or more in diameter as contrast to the maximum diameter food product of 2¾ inches for the know slicing devices.

DETAILED DESCRIPTION OF THE PREFERRED EMBODIMENT

Figure 1:
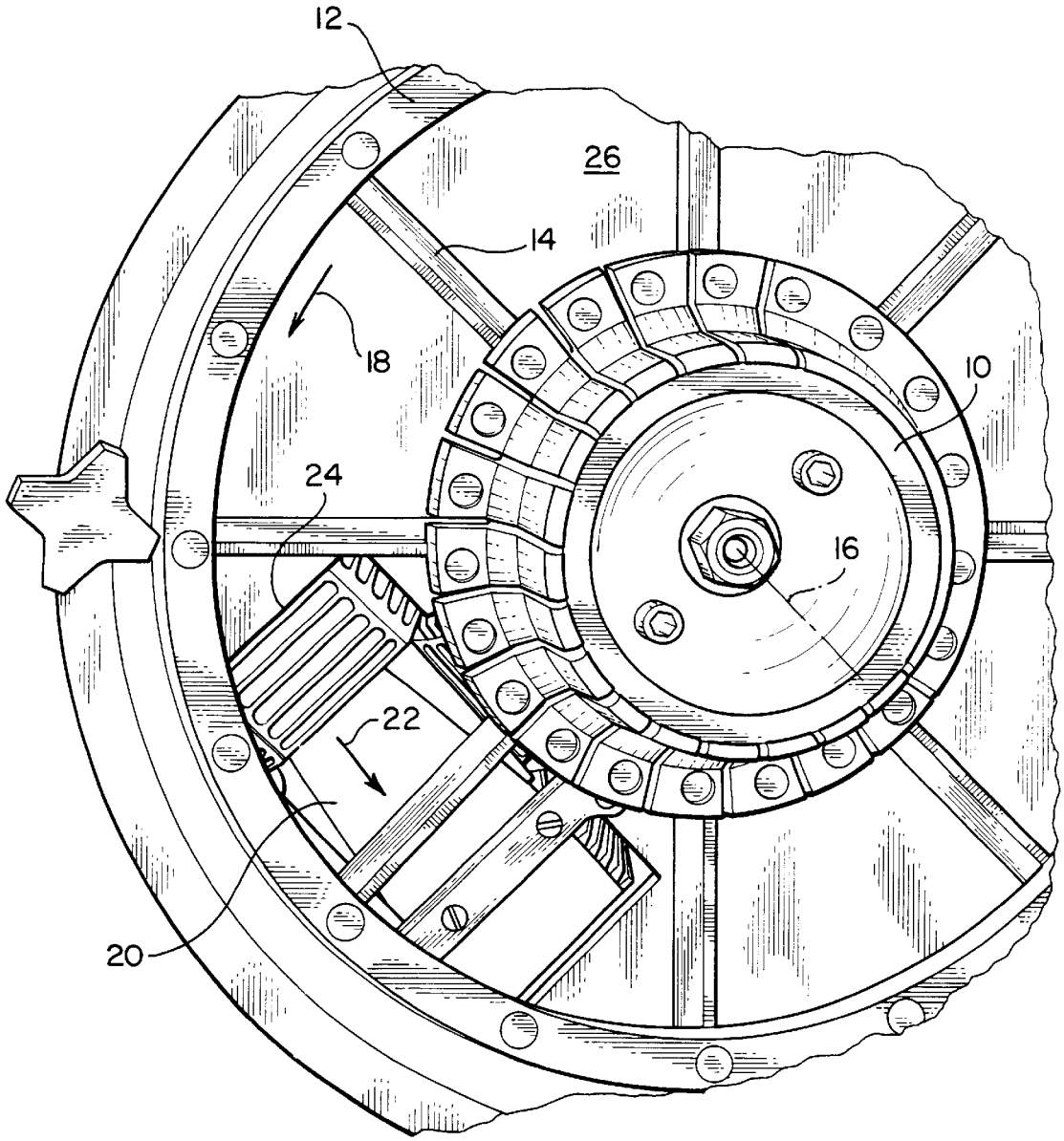
FIG. 1 (PRIOR ART)
FIG. 1 is a partial, end view of a known food slicing device.
Figure 2:
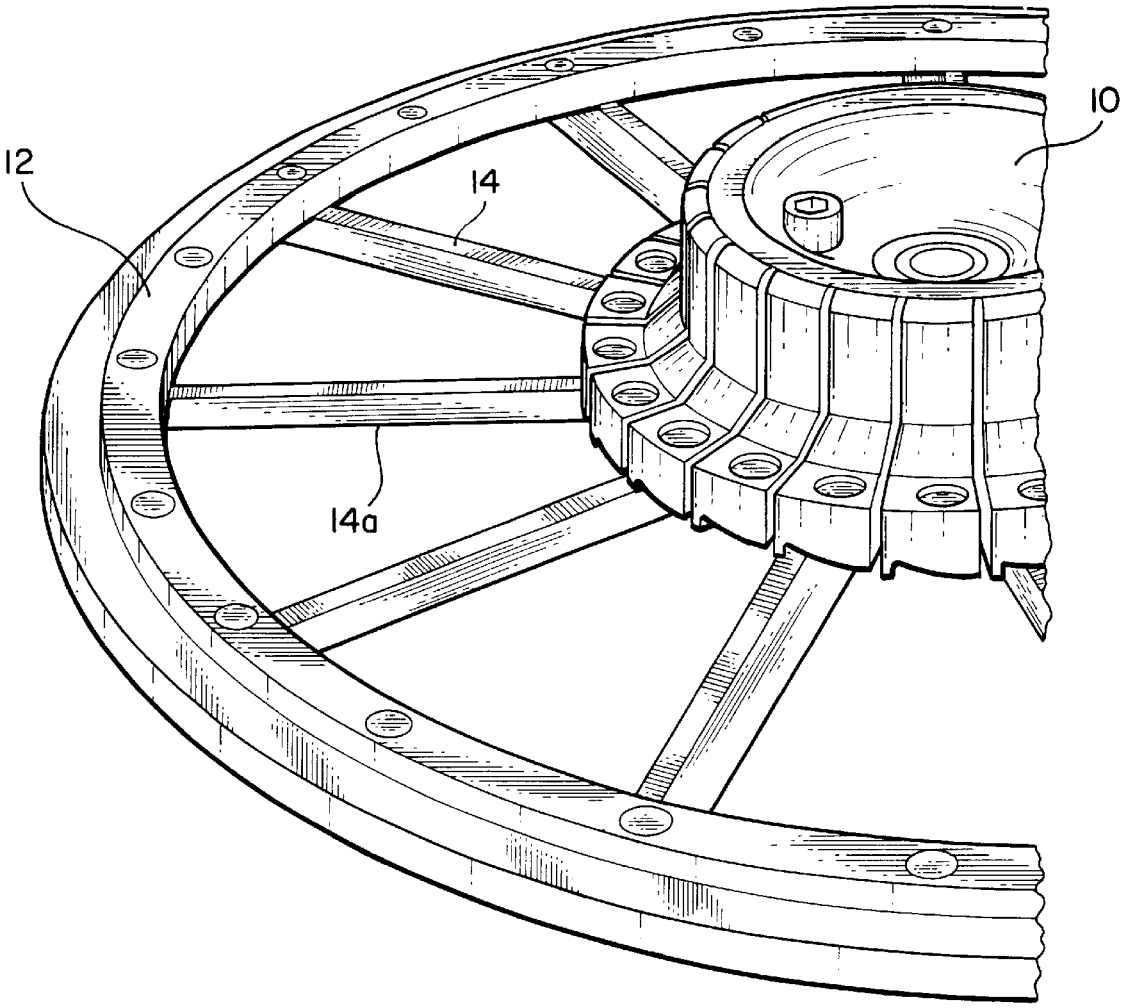
FIG. 2 (PRIOR ART)
FIG. 2 is a partial, perspective view of the cutting wheel used in the known slicing device.

FIGS. 1 and 2 illustrate a cutting wheel of a known food slicing apparatus, such as the devices illustrated in U.S. Pat. Nos. 2,482,523 and 3,004,572. The cutting wheel comprises a hub 10 and a rim 12 interconnected by a plurality of knives 14. The cutting wheel is rotated about an axis 16 in the direction of arrow 18 while the food to be sliced is transported by conveyor 20 in the direction of arrow 22. The food product passes through opening 24 in support structure 26 and is sliced by the blades 14 into uniform slices. The cutting wheel is shown in a partial perspective view in FIG. 2. As can be seen, the knives 14 are generally planar in configuration extending generally radially between hub 10 and rim 12 and may have sharpened edge portions 14*a*.

Figure 3:
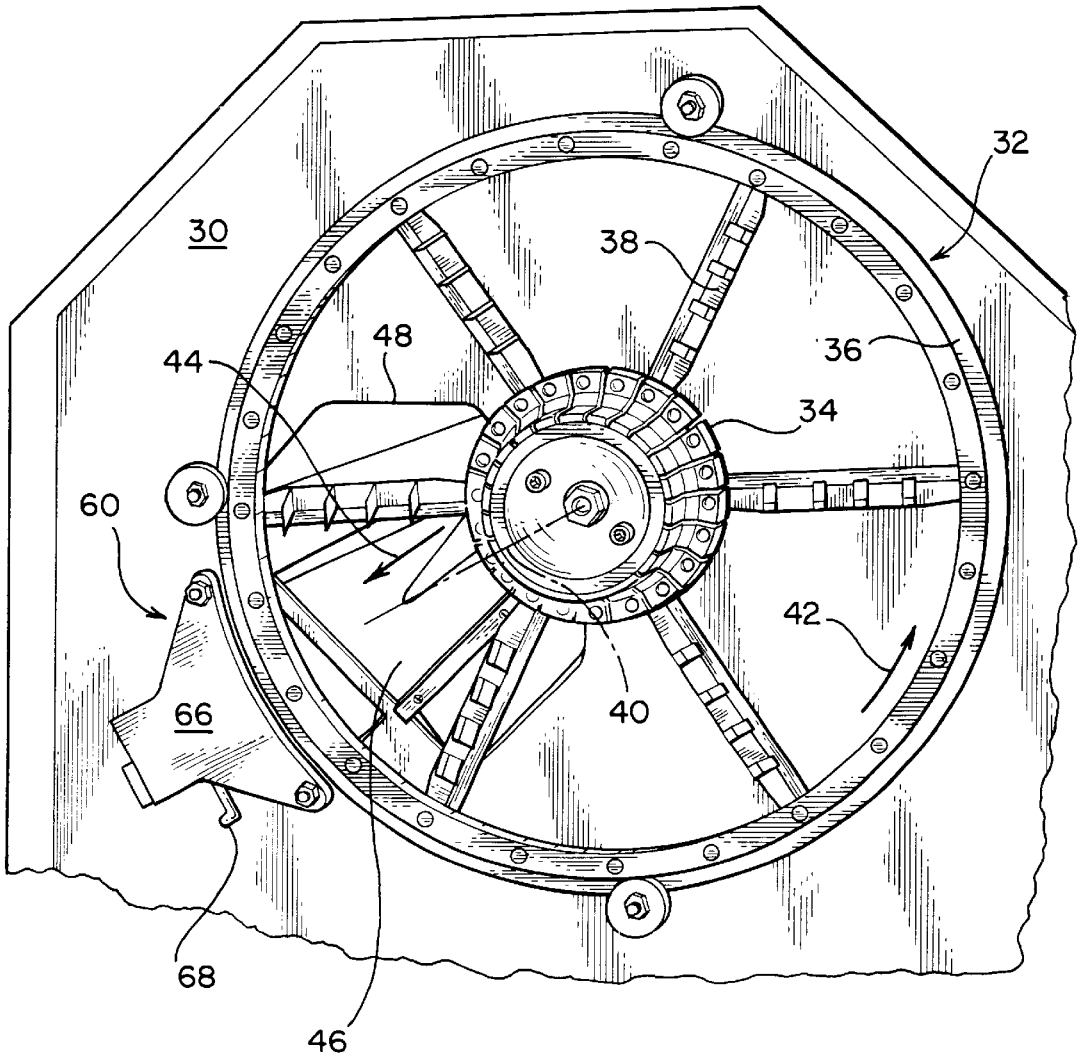
FIG. 3 is a partial, perspective view of the cutting apparatus according to the present invention.

The cutting apparatus according to the present invention is illustrated in FIG. 3 and comprises a support structure 30 which rotatably supports a cutting wheel 32 comprising a hub 34, a rim 36 and a plurality of knives 38 which interconnect the hub and rim, and which may extend generally radially from the hub. The cutting wheel 32 rotates about axis 40 in the direction of arrow 42 by a connection to a drive motor which is used to only drive the cutting wheel 32.

Figure 6:
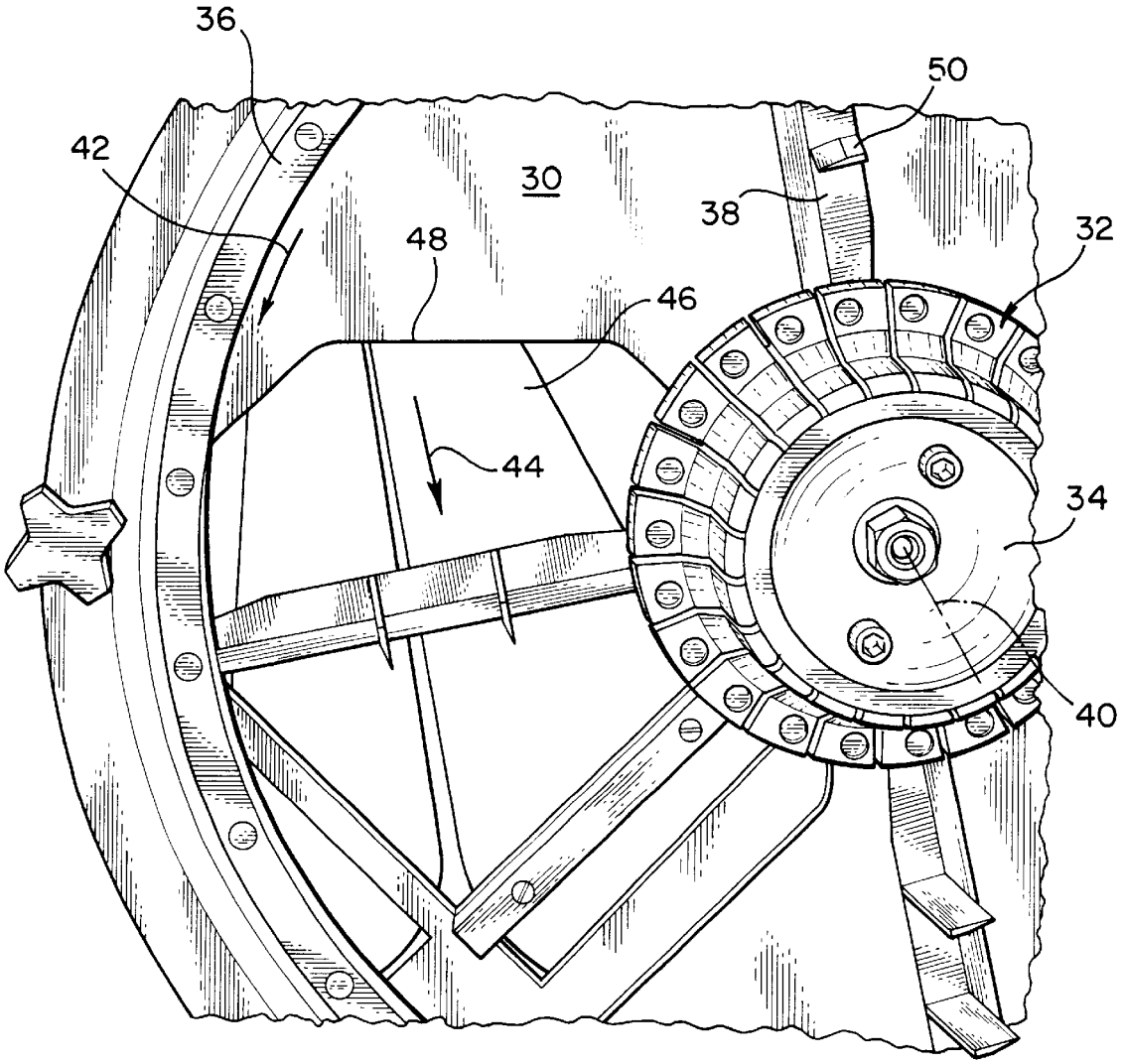
FIG. 6 is a partial, end view of a cutting apparatus according to the present invention illustrating the cutting wheel of FIG. 4.
Figure 7:
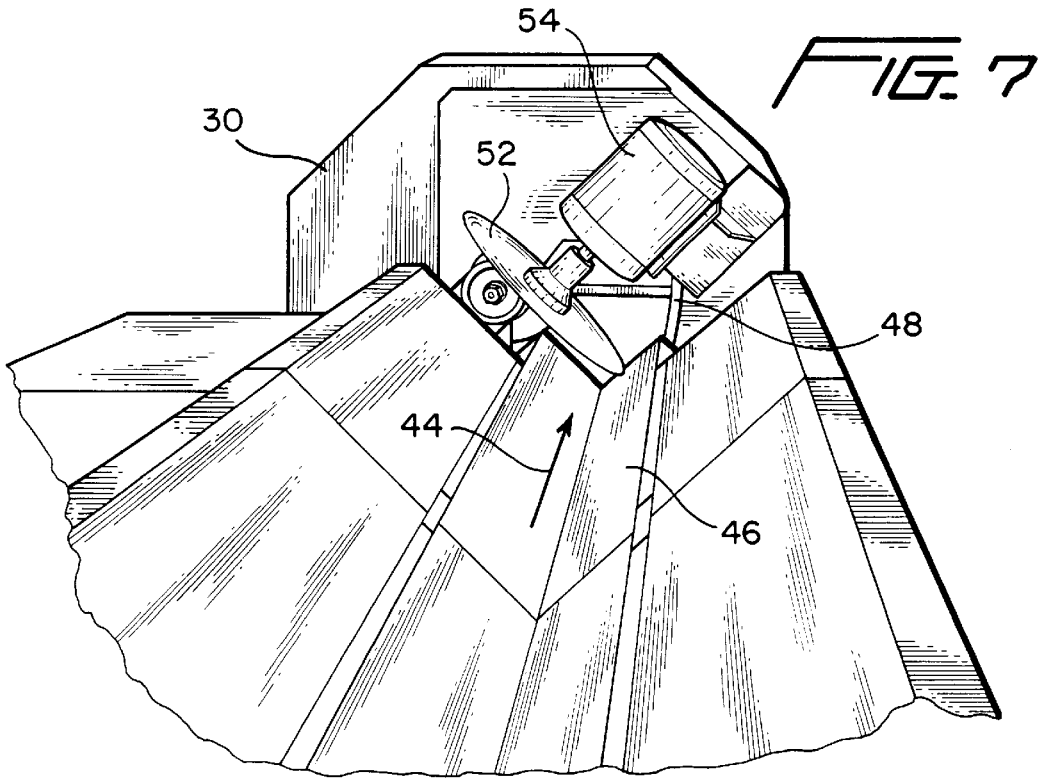
FIG. 7 is a partial, perspective view of the cutting device according to the present invention incorporating a single circular cutting knife.

As shown in FIGS. 3 and 6, the food product is conveyed in the direction of arrow 44 by conveyor 46 such that it passes through opening 48 in the support structure 30 and through a cutting plane defined by the cutting knives 38 as they rotate about axis 40.

Figure 4:
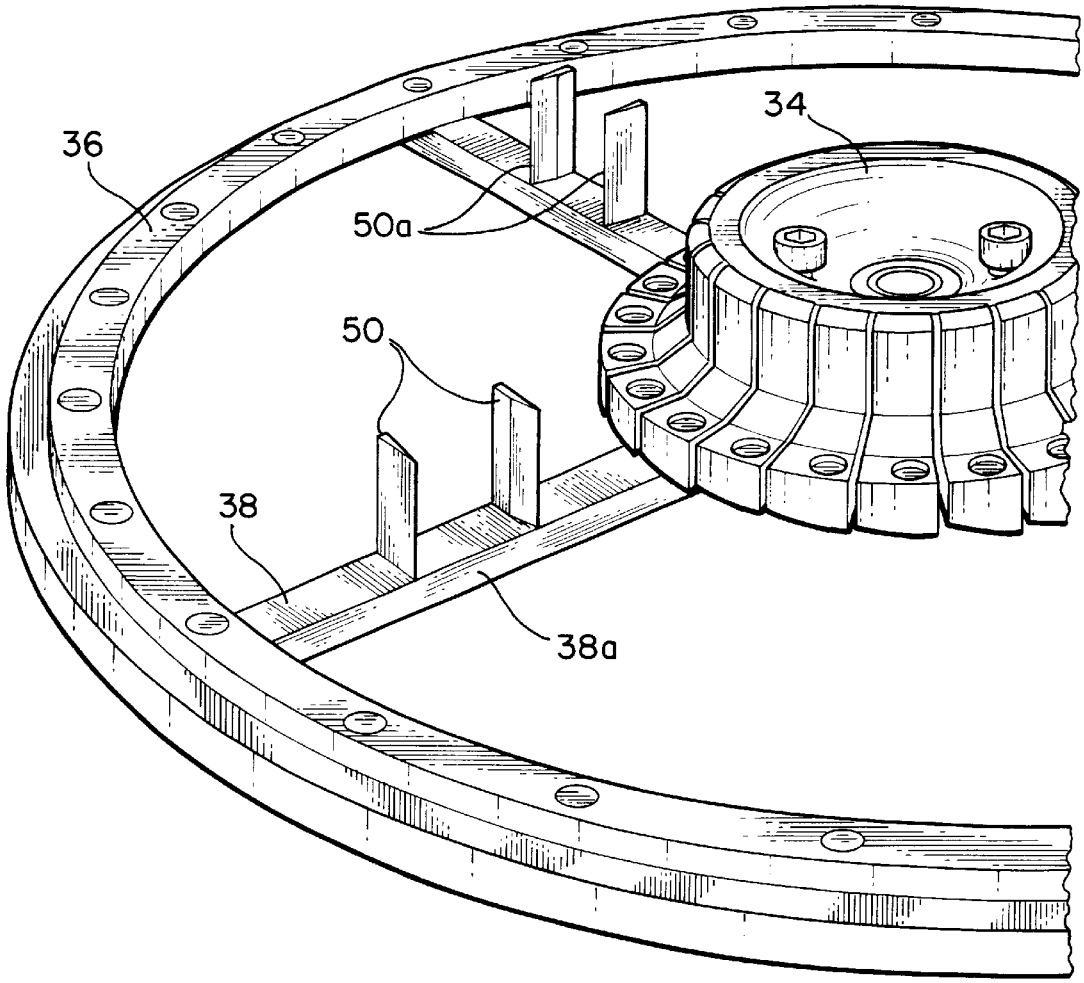
FIG. 4 is a partial, perspective view of the cutting wheel according to a first embodiment of the present invention.
Figure 5:
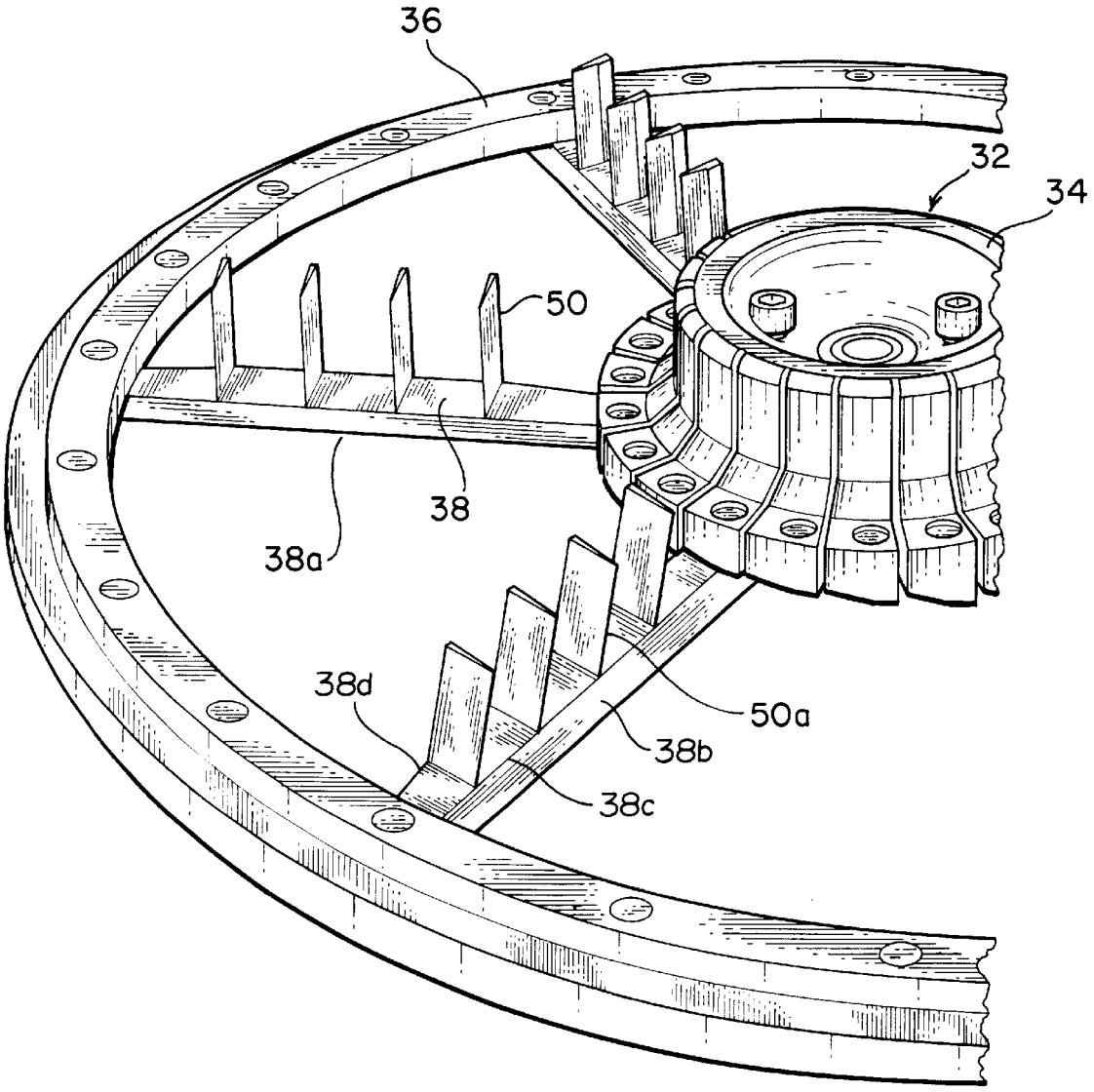
FIG. 5 is a partial, perspective view of a cutting wheel according to a second embodiment of the preset invention.

As illustrated in FIGS. 4 and 5, the cutting wheel according to the present invention may have one or more julienne knives 50 extending generally perpendicularly from the plane of the knives 38. The julienne knives 50 are each shorter than the knives 38 and may have sharpened cutting edges 50*a* and knives 38 may have sharpened edges 38*a* resulting from single levels 38*b* terminating at bevel edges 38*c*. Julienne knives 50 may be attached to the knives 38 in a cantilever manner by brazing or the like. As illustrated in FIGS. 4 and 5, different numbers of julienne knives 50 may be attached at one end thereof to the knives 38 depending upon the desired size of the final cut product. Each knife 50 extends a distance widthwise between the bevel edge 38*c* and the rearward edge 38*d* of knives 38, occupy a majority of such width, and are all spaced an equal distance from the leading edges of knives 38. As the food product passes through the opening 48 in the support structure 30, it is not only cut in one direction by knives 38, but it is also cut in a perpendicular direction by the julienne knives 50. Thus, the present invention may impart a multi-dimensional cut to the food product as opposed to the single dimensional cut imposed by the known slicing apparatus.

In order to dice some food products, it may also be desirable to incorporate an additional knife upstream of the cutting plane of the cutting wheel 32. This may take the form of a circular knife 52 rotated by drive motor 54 which is stationarily attached to the support structure 30. Use of the circular knife 52 in conjunction with the julienne knives 50 attached to the knives 38 has resulted in a diced food product, such as Iceberg lettuce, equal to the quality of the known dicing apparatus, but attainable at a significantly higher quantity. Known dicing machines are capable of dicing approximately 4,000 lbs. of lettuce per hour while the present invention is capable of dicing approximately 15,000 lbs. of lettuce per hour assuming that the lettuce heads are spaced approximately three feet apart on the feed conveyor 46.

Figure 8:
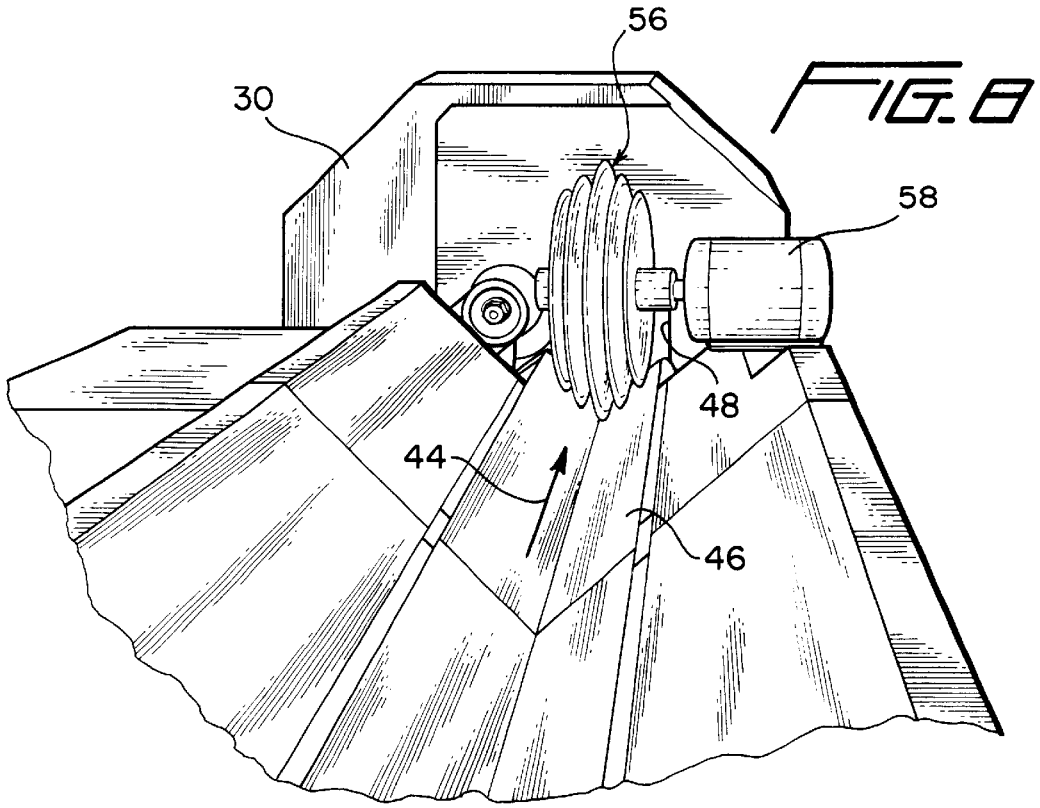
FIG. 8 is a view similar to FIG. 7, but illustrating the use of multiple circular knives.

It is also possible to utilize a plurality of circular knives to impart a plurality of longitudinal cuts to the food product before it passes through the slicing plane of the cutting wheel 32. This is illustrated FIG. 8 wherein a plurality of generally parallel circular knives 56 are rotated by motor 58 which is, again, attached to stationary support structure 30.

Figure 10:
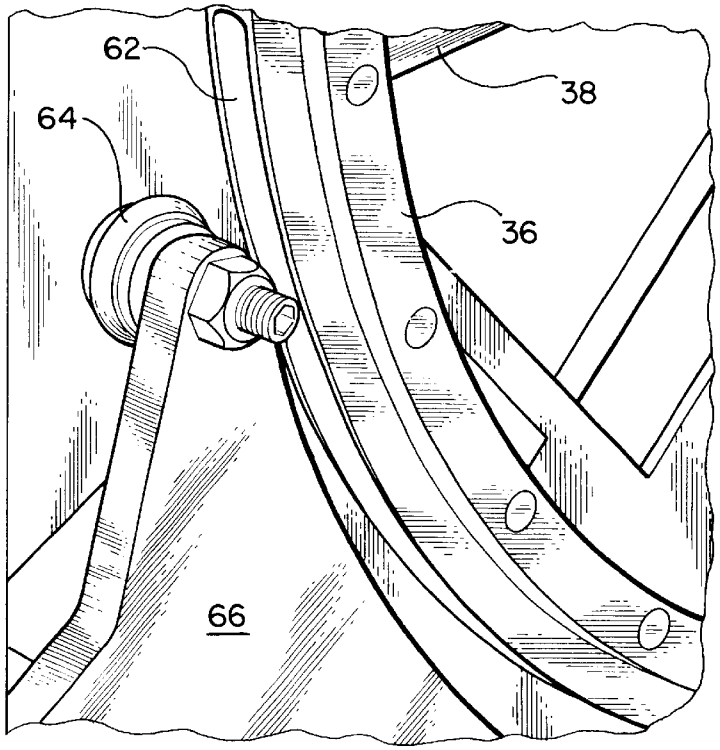
FIG. 10 is a partial, enlarged view of the rim stabilizer illustrated in FIG. 9.
Figure 9:
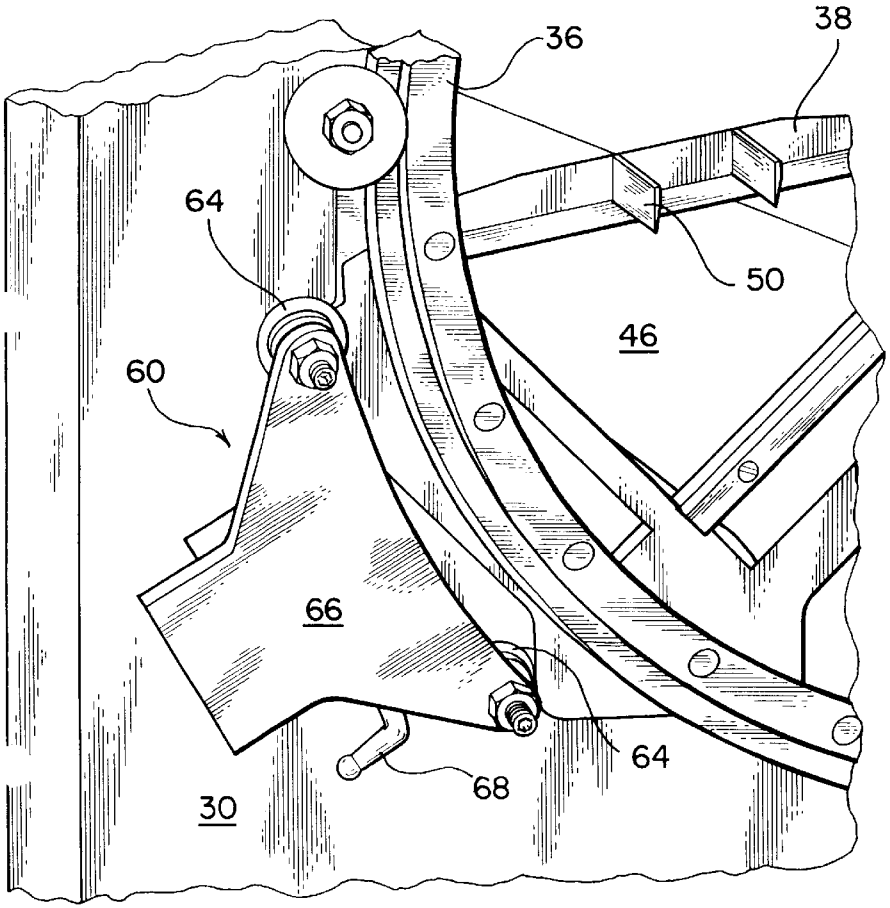
FIG. 9 is a partial view of a rim stabilizing device utilized with the present invention.

As noted previously, the conveyor 46, which may be either a double endless belt, V-shaped conveyor, or a flat endless conveyor belt, is powered by a motor drive means which is completely separate from the motor drive means rotating the cutting wheel 32. The structure of the present cutting apparatus is significantly larger than the known slicing machines which enables it to cut a larger size of food product at a higher capacity than the known devices. However, the significantly larger diameter of the cutting wheel 32 may allow deflection from the cutting plane which will cause the food product to be improperly cut, or possibly cause damage to the cutting wheel itself by contact with the stationary structure. In order to avoid this possibility, the cutting apparatus may include a rim stabilizer 60 illustrated in FIGS. 3, 9 and 10. The rim 36 of the cutting wheel 32 defines a circumferential, curved groove 62 about its outer periphery which is engaged by rollers 64 rotatably attached to rim stabilizer body 66. Rim stabilizer body 66 may be movably attached to the stationary support structure 30 via a lockable dovetail slide mechanism such that it may be moved to a position wherein the rollers 64 are disengaged from the groove 62. This facilitates removable of the cutting wheel 32 from the apparatus. The rim stabilizer 60 may be locked in its stabilizing position, in which the rollers 64 engage the groove 62 by known locking means actuated by lever 68.

Figure 11:
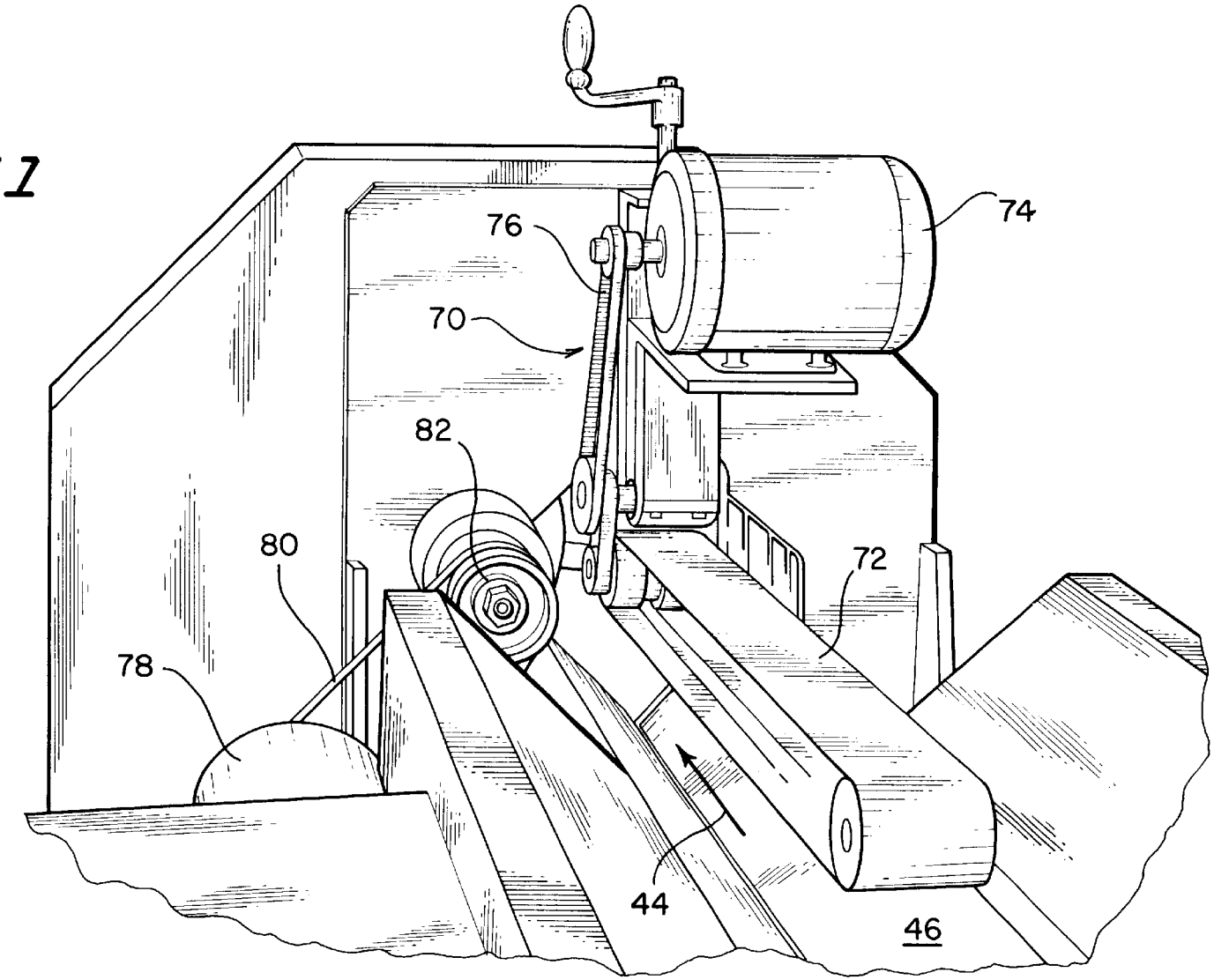
FIG. 11 is a partial perspective view illustrating the cutting apparatus according to the present invention utilized with a top feed belt.

As illustrated in FIG. 11, the present invention may also utilize a top feed conveyor assembly 70 which comprises a top endless conveyor belt 72 driven by motor 74 via belt drive 76. This drive mechanism may be utilized under certain conditions wherein it is desired to impart a greater degree of stability to the food product as it is conveyed to the cutting plane. FIG. 11 also illustrates the drive motor 78 for rotating the cutting wheel 32. This may be achieved by drive belt 80 which passes around a drive pulley driven by the motor 78 and a driven pulley 82 which, by known means, is attached to the cutter wheel drive shaft. Motor 78 is separate from the motor (not shown) which powers conveyor 46 and from that which powers conveyor belt 72. This avoids the necessity of using a complicated drive transfer mechanism of the known slicing devices.

The foregoing description is provided for illustrative purposes only and should not be construed as in any way limiting this invention, the scope of which is defined solely by the appended claims.

What is claimed is:

1. A cutting blade for an apparatus for cutting a food product, comprising:

an elongated generally planar first knife blade having a first length and first and second opposite facing sides joined by opposed edges, one of said edges provided with a bevel on one side only to define a continuous first beveled cutting edge extending substantially along the length of the first knife blade, said bevel terminating along an inner bevel edge, the edge opposed from said first cutting edge spaced from said first cutting edge and said first knife blade having a length extending along the cutting edge and a width extending perpendicular to the cutting edge; and a plurality of second thin, planar knife blades each having a second length less than the length of the first knife blade and having opposed sides joined by edges and being directly and permanently secured without a separable holder device in a cantilever manner to the first side only of the first knife blade in spaced apart relationship so the opposed sides of each second knife blade extend across a majority of the width of the first knife blade between the inner bevel edge of the first beveled cutting edge and the opposed edge, with each second knife blade extending generally perpendicular from the first side of the first knife blade, one edge of each second knife blade being sharpened so as to define second cutting edges located adjacent to and facing said beveled cutting edge of the first knife blade, said second cutting edges of the second knife blades being spaced an equal distance from the first beveled cutting edge.

* * * * *